US006672393B2

(12) United States Patent
Vann

(10) Patent No.: US 6,672,393 B2
(45) Date of Patent: Jan. 6, 2004

(54) RECIPROCATING PUMP DUMP VALVE AND METHODS OF USE

(76) Inventor: Roy R. Vann, 9517 Tosha La., Flint, TX (US) 75762

( * ) Notice: Subject to any disclaimer, the term of this patent is extended or adjusted under 35 U.S.C. 154(b) by 0 days.

(21) Appl. No.: 10/374,566

(22) Filed: Feb. 25, 2003

(65) Prior Publication Data

US 2003/0159830 A1 Aug. 28, 2003

Related U.S. Application Data

(60) Provisional application No. 60/360,240, filed on Feb. 26, 2002, and provisional application No. 60/392,991, filed on Jul. 1, 2002.

(51) Int. Cl.[7] ..... E21B 34/00
(52) U.S. Cl. ..... 166/373; 166/377; 166/386
(58) Field of Search ..... 166/373, 377, 166/386

(56) References Cited

U.S. PATENT DOCUMENTS

| | | | | |
|---|---|---|---|---|
| 3,150,605 A | | 9/1964 | Howe | |
| 3,994,338 A | | 11/1976 | Hix | 166/105 |
| 4,103,739 A | | 8/1978 | Hall | 166/105 |
| 4,273,520 A | | 6/1981 | Sutliff et al. | 417/434 |
| 4,603,741 A | * | 8/1986 | Edgmon | 166/373 |
| 4,645,007 A | | 2/1987 | Soderberg | 166/374 |
| 4,909,326 A | | 3/1990 | Owen | 166/317 |
| 5,018,581 A | | 5/1991 | Hall | 166/373 |
| 5,782,303 A | * | 7/1998 | Christian | 166/373 |

OTHER PUBLICATIONS

Sheet from Harbison–Fischer Mfg. Web Page (www.hf-pumps.com) showing information for a Bottom Discharge valve.

* cited by examiner

*Primary Examiner*—David Bagnell
*Assistant Examiner*—Matthew J Smith
(74) *Attorney, Agent, or Firm*—C. W. Alworth

(57) ABSTRACT

A reciprocating pump dump valve and methods of use for utilization in the hydrocarbon industry. The device is preferably used with barrel pumps although it may be used with tubing pumps. The device is positioned at the bottom of the wellbore immediately above the stinger and immediately below the standing valve and allows for complete dumping of the hydrostatic head in the production tubing whenever the tubing must be pulled.

3 Claims, 8 Drawing Sheets

RECIPROCATING PUMP DUMP VALVE AND METHODS OF USE

This application claims priority from Provisional Patent Application No. 60/360,240 filed on Feb. 26, 2002 and Provisional Patent Application No. 60/392,991 filed on Jul. 1, 2002.

The present invention relates generally to the oil and gas industry: in particular to oil well production utilizing reciprocating pumps and the servicing of same.

BACKGROUND OF THE INVENTION

Oil wells are produced using a variety of methods ranging from self-production, where the formation pressure is high enough to cause the oil to flow up the wellbore, to various forms of artificial lift, where the formation pressure is insufficient and cannot lift the hydrocarbon fluid up the wellbore. The most common artificial form used in the oil industry is the reciprocating pump.

The standard industry reciprocating pump consists of a prime mover that is positioned at the surface, and a pumping barrel that is positioned within the production tubing at or near the bottom of the wellbore. The wellbore is lined with steel pipe called casing.

The production tubing is concentric within the casing and is the conduit through which produced fluids are sent to the surface. The area between the production tubing and the casing (wellbore) is called the annulus. The production tubing is generally suspended from the surface and "rests" against the casing forming a seal at the surface. The steel casing has a series of holes or perforations punched in the casing where the producing formation is found, that allow the formation fluid to enter the annulus.

The production tubing has a "seating nipple" at the formation end of the tubing into which the pump will seat. The tubing may be terminated in a rounded end with a series of perforations that act as a course filter and allow the formation fluid to enter the production tubing. The seating nipple has a reduced inside diameter when compared to the tubing that forms a hold-down into which the pump barrel locks or is held-down. The barrel is locked into place within the production tubing so that a seal is formed between the pump and the production tubing. This seal keeps the produced fluid from re-entering the formation.

There are two ways by which the pump at the end of the production tubing is driven (reciprocated). The first uses the industry standard sucker rods, and the second uses a new technique that employs a wire cable. Both the cable and the sucker rod string terminate at the pump and at the prime mover. A cable driven pump will employ the same (or similar) pull rod at the downhole end. Thus, the sucker rod string in a sucker rod driven pump and the cable in a cable driven pump terminate in the pull rod.

After a period of time, the downhole pump must be serviced, and the cable or sucker rod string is employed to lift the pump up and out of the well. The pump is pulled up to the surface within the production tubing. A certain amount of force is required to "pop" the pump loose from the hold-down at the bottom of the production tubing.

Very often the force to "pop" the pump loose is excessive and is caused by "flower sand" buildup around and about the pump at the hold-down. Flower sand is entrained in the produced fluid and tends to precipitate from the fluid as it passes up the production tubing. The sand then falls to the bottom of the tubing and "packs" around the hold-down thereby substantially increasing the force required to "pop" the pump loose from the hold-down.

Further more because there are series of ball and check valves within the pump, the initial force required to "pop" the pump loose must also pull against the hydrostatic head contained within the production tubing which thereby increases the required unseating force. As the depth of the well increases, the weight of the produced fluid increases: essentially, the weight of produced fluid is related to the hydrostatic head contained within the production tubing. As soon as the pump pops loose the hydrostatic head will reduce because the fluid in the production tubing will U-tube within the annulus and tubing.

There have been instances when the sucker rod string breaks, due to the high force required to "pop" the pump loose, thus leaving the pump in the tubing. At this point, the well operator must pull the production tubing to retrieve the pump: an expensive operation. In the case of the wire cable driven pump, the wire cable is often limited in pulling force, and the tubing would have to be pulled.

Among some of the prior art attempting to solve the problem caused by sand buildup and hydrostatic head are: Hall (U.S. Pat. Nos. 5,018,581 and 4,103,739), Hix (U.S. Pat. No. 3,994,338), Howe (U.S. Pat. No. 3,150,605), Owen (U.S. Pat. No. 4,909,326), Sonderberg (U.S. Pat. No. 4,645,007) and Sutliff et al. (U.S. Pat. No. 4,273,520. Hall envisions an auxiliary valve-like device that is placed at some point (mid) in the pump barrel as the barrel is being made up. This valve opens during withdrawal of the pump if the pulling force exceeds a predetermined force caused by sand buildup. If the device does not open, then it is assumed there is no sand buildup and the device may be re-inserted into the wellbore.

Hix describes a frangible rupture disk that is placed between the standing valve and the hold down in a barrel pump assembly. The rupture disk is activated by increasing the pressure in the standing column of produced fluid; thus, some sort of pumping device is required at the surface. The device also incorporates a left hand thread that allows the pump to be unscrewed if the rupture disk fails to rupture. This is a one shot device.

Howe illustrates a complex ball and seat device that is placed at the pump head and drains the tubing fluid above and around the pump whenever the pump is raised out of the tubing. It does not release the hydrostatic head in the tubing.

Owen portrays a tubing unloader that is placed in the tubing itself. As the tubing is pulled upward the unloader opens and allows the entrapped fluid to drain back into the annulus.

Sonderberg also describes a tubing unloader that is placed in the tubing like the device of Owens. However, the Sonderberg device uses an increase in fluid pressure to open the device. Again this implies some sort of pump source at the surface. Finally, Sutliff et al. disclose a deep well pump that incorporates a drain valve that allows the pump to drain within the tubing so that the pump is basically pulled dry from the well.

The industry has attempted to solve the flower sand problem by using a bottom discharge valve mounted below the pump, but above the lower check valve (stationary valve), that allows back flow of produced fluid, thereby causing a swirl that hopefully picks up the sand about the hold-down reducing the force required to "pop" the pump loose. The valve which is really a second check valve that, on the downstroke, allows flow of produced fluid from the pump barrel into the tubing (Note the valve is spring loaded so that downward force is required to force the produced fluid backwards into the tubing.) The by-passed flow causes a swirl around the bottom section of the pump and up into the tubing. The device helps but, because it is located away from the hold-down, it is somewhat inefficient when washing sand. The force required to push the fluid through the bottom discharge valve is supplied by the weight of the sucker rod string (coupled through the pull rod). The required force ("weight") is unavailable in a cable driven pump. ("One cannot push on a rope.") The industry has not resolved the hydrostatic head problem.

Thus, there remains a need for a device that will wash the flower sand buildup from about the hold-down within the production tubing and/or reduce hydrostatic head, thereby reducing the force required to "pop" a pump loose for servicing. The need is even higher for cable driven pumps.

SUMMARY OF THE INVENTION

The prototype device is about 12 inches long, consists of three major parts and would be run between the ball and seat and the hold down (stinger) prior to being placed in the wellbore. The first part is the outer barrel that attaches to a standard hold-down stinger. The second part is a hollow moving piston within the barrel. The third part is header that attaches to the piston and to the bottom of the pump barrel immediately below the ball and seat. Produced fluid normally flows from the hold-down stinger, through the hollow piston, through the header, and into the ball and seat assembly associated with the pump.

The piston has a set of apertures, called dump aperture(s) or dump port(s), and a series of seal O-rings. The O-rings and apertures remain within the barrel until activated by forces applied from the surface. The dump port(s), if exposed from within the barrel, will allow fluid to flow from the hollow aperture.

The device has three "positions." These positions are the entry position, the cocked closed or safety position and the dump position. The entry position is the initial position and is kept in this position by an entry shear pin or a set of entry shear pins. In the entry position, the header is approximately ½-inch above the barrel. At the same time the "dump" port(s) remain(s) "locked" within the barrel. No fluid can pass from within the hollow piston and the outside of the barrel. Produced fluid only flows from the formation into the pump and onto the surface.

Allow some time to pass and require that the pump be served. The operator allows the reciprocating system to drive the device downwards toward the bottom of the well. This action shears the "entry" shear pin(s) and allows the header to come into contact with the barrel. The device is now "cocked" in that it may be opened. The operator then draws up on the reciprocating system causing the piston to move upwards within the barrel towards the top of the device. Additional upward force is required to shear the "safety-pin(s)" within the barrel. This then allows the piston to move further upward exposing the "dump port(s)" that allow(s) for reverse flow. The reverse flow will allow the hydrostatic head to dissipate into the annulus, and, if required, wash flower sand from around the hold-down; thereby, reducing the total pull required to "pop" the pump loose and withdraw it from the well.

DETAILED DESCRIPTION OF THE EMBODIMENT

The device disclosed may be used in conjunction with tubing pump method, stationary pump barrel method, traveling barrel pump method, and other pumping methods that require a standing valve. The oil industry generally defines a standing valve as a valve that causes produced fluid to "stand" in the production tubing. When used in pumping operations, the standing valve is a check valve (usually one or more ball and seat valves) that allows for the one-way passage of produced fluid from the formation to the surface.

The tubing pump method is probably the most common method of pumping. In the past, when using the tubing pump method, and prior to beginning pumping operations, a standing valve is dropped from the surface to seat into a standard seating nipple located at the bottom of the production tubing. This standing valve provides a means to apply pressure down the tubing to check its integrity and to check the seal the ball and seat, prior to inserting the tubing pump and beginning pumping operations.

Figure 7:
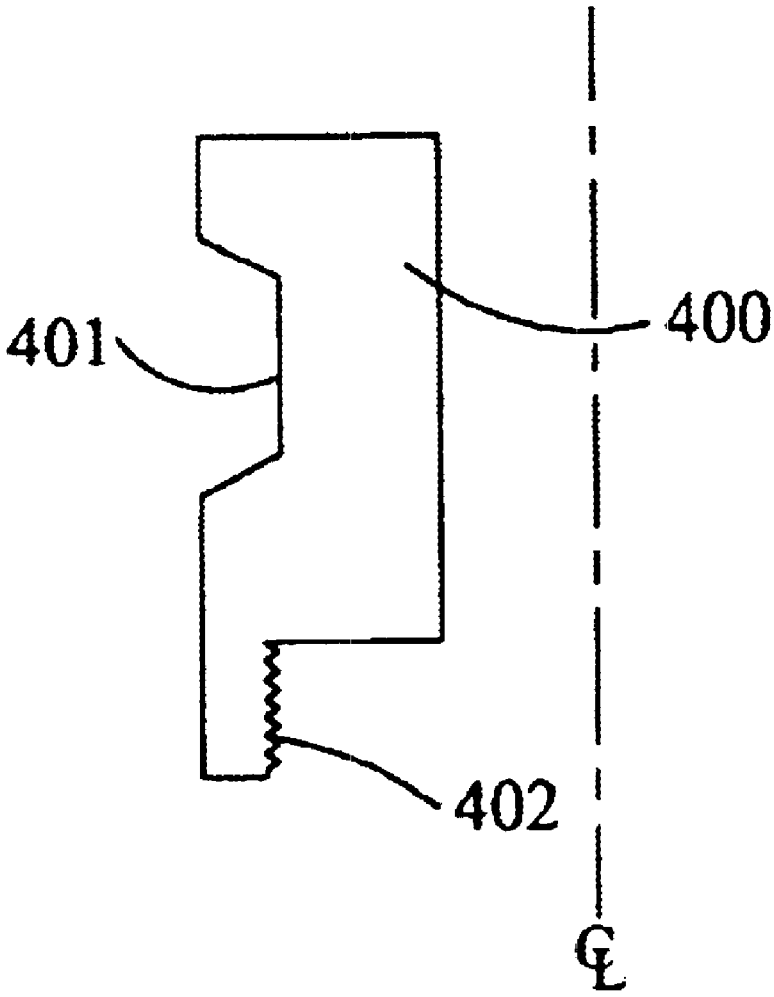
FIG. 7 is a cross-sectional view of a fishing neck attachment used in tubing pump applications.

A minor change in standard procedure is employed when using the instant device with a tubing pump. The instant device is first attached to a standard stinger and standing valve, and the assembly is dropped down the tubing so that the device comes to rest in the seating nipple with the standing valve located on top. The complete assembly now provides a means to apply pressure down the tubing to check its integrity and to check the seal the ball and seat, prior to inserting the tubing pump and beginning pumping operations. (It may not be necessary to run the safety or entry shear pins in the instant device, as will be explained.) Optionally a fish neck (FIG. 7) may be attached to the standing valve.

Typically in the tubing pump method, the standing valve assembly is not retrieved unless the tubing needs to be pulled. If the tubing needs to be pulled, the recommended procedure, which is commonly practiced today when rods are run, is to lower the sucker rod string assembly and thread onto (by rotation) the standing valve and pull up until assembly is released from seating nipple. This sometimes requires a large amount of tension due to hydrostatic and friction forces. As will be explained, the present invention allows the dumping of fluid prior to releasing the hold down from the seating nipple, which will make retrieval easier.

As can be readily expected, the sucker rods allow for sufficient force to be transmitted down the tubing to the standing valve allowing the standing valve to be pulled upwards against the hydrostatic head, friction forces and seating force thereby removing the valve from the tubing. The removal of the standing valve allows the production tubing to drain as the tubing is later pulled. When a cable pump is used with the tubing pump method the cable cannot transmit sufficient force to the standing valve to overcome the hydrostatic head, friction forces and seating force. Therefore the assembly, described above, of the instant device and a standard standing valve must be employed. When the assembly is used, the cable and special retrieval tool (see FIG. 7) is used to open the dump valve, thereby dumping the fluid in the production tubing and then pulling the entire assembly from seating nipple.

The instant device can also be applied to other pumping methods such as the "traveling" barrel pump system and the "stationary" barrel pump system using similar installation methods. The former system reciprocates to recover fluid on the downstroke whereas the latter system reciprocates to recover fluid on the upstroke. In the barrel pump application the device is attached to the bottom of the standing valve that is attached to the pump. The pump barrel, the instant device, the standing valve and the pump are then "run" (a term of art meaning place into a well) on same trip in a well.

In most pump methods where a standing valve is run prior to running pump assembly and/or the invention is run while running a pump barrel on the same trip in well, and when the invention is run and operated as intended, the pulling of a "wet string" should be eliminated and ease of removal from the seating nipple should be enhanced.

Figure 6:
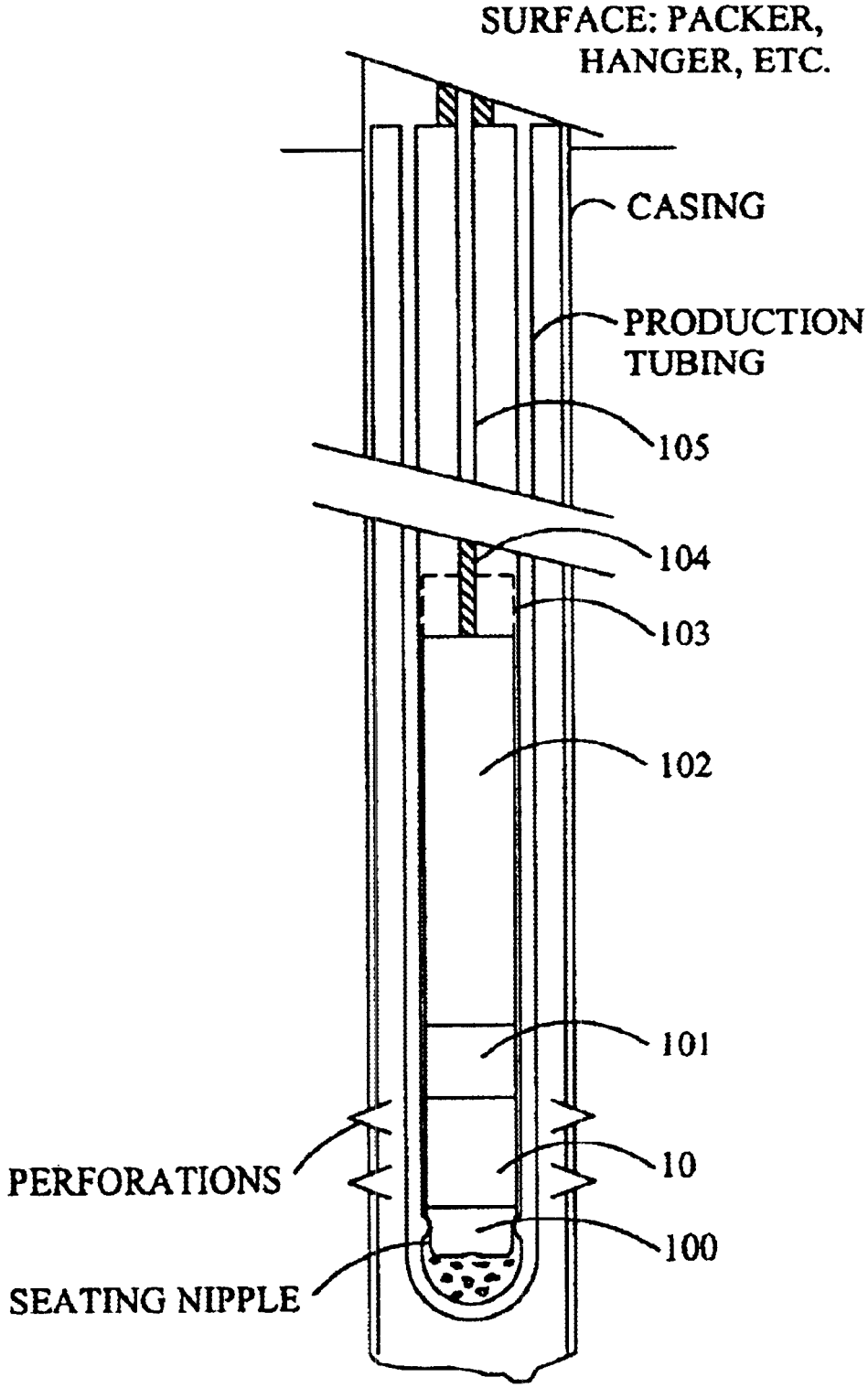
FIG. 6 is a simplified illustration of a wellbore showing the production tubing, a series of sucker rods terminating in a pull rod that is connected to a pump plunger that in turn operates within a pump barrel, and the instant invention connected at the bottom of the pump barrel.

Referring to FIG. 6, the instant invention, the dump valve, 10, which is cylindrical in overall shape is shown in place on a standard art reciprocating pump, 102, as currently used in the industry (with a stationary barrel). The description of the embodiments of the instant device will use a stationary barrel pump; however, the instant device will operate with a reciprocating barrel or tubing pump as explained above. Shown in the drawing are the usual standard pull rod, 104, and sucker rod string, 105. The instant device, 10, is located immediately below the standing (ball and seat) valve assembly of the pump, 101, and screws into the standing (ball and seat) valve assembly. The valve cage or stinger, 100, that also interlocks with the seating nipple on the production tubing, screws into the bottom of the instant device. Also shown is the optional upper standing head valve, 103, that is the subject of U.S. Pat. No. 6,382,244 to the present inventor. The upper standing head valve is designed to keep the wellbore (fluid within the production tubing) hydrostatic head away from the formation.

The instant device consists of three basic parts, the barrel, 1; the head, 3; and the piston, 2; plus several ancillary parts. The ancillary parts are the safety ring, 4; the safety shear pin, 6; the entry shear pin(s), 7; three piston O-rings, 8, and one optional safety ring O-ring, 9, that are placed in associated O-ring grooves located on the piston and/or safety ring.

Figure 1:
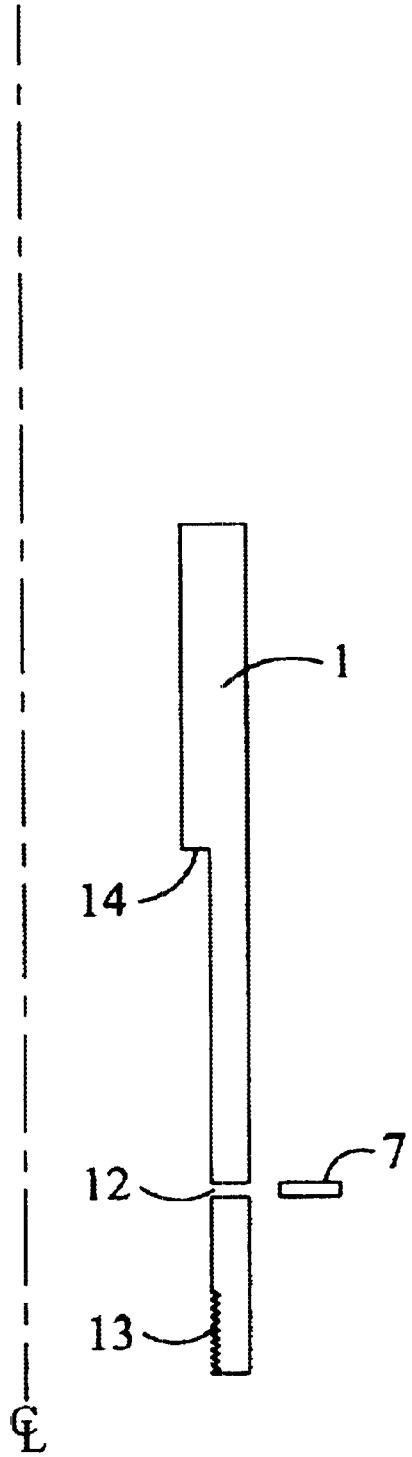
FIG. 1 is a cross-sectional view of the barrel of the instant device showing the entry shear pin.
Figure 2:
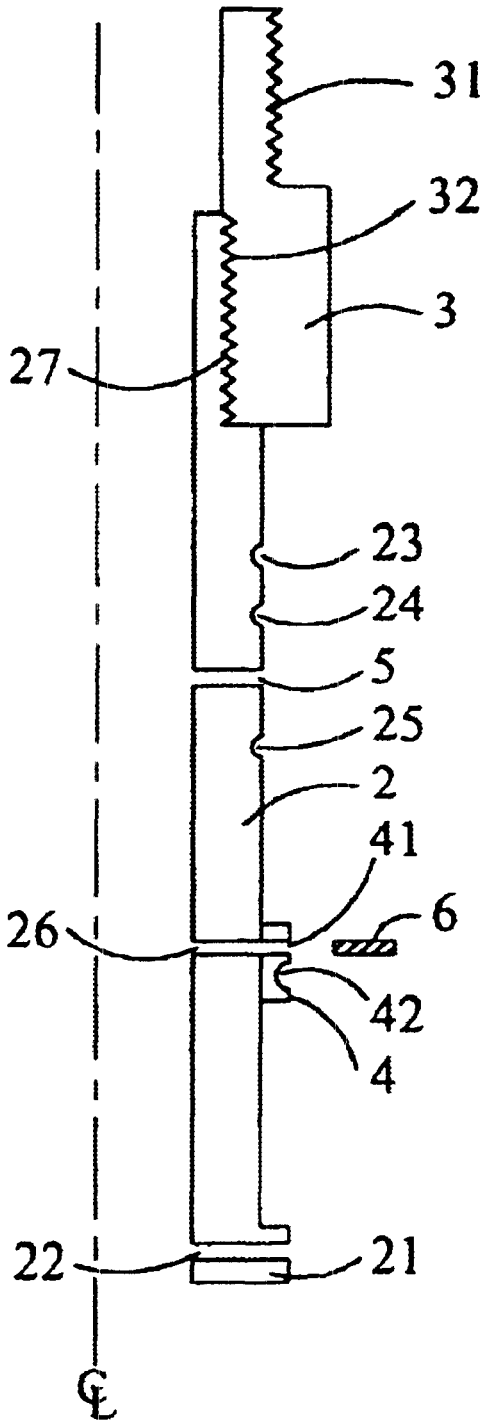
FIG. 2 is a cross-sectional view of the piston, safety ring and head of the instant device showing the safety shear pin.

Referring to FIG. 2, the head, 3, is shown screwed onto the piston, 2, the reason that these two parts screw together will become apparent later. Located on the piston are a series of O-ring grooves, 23, 24, and 25. These grooves accept O-rings, 8, as shown in FIG. 3 through FIG. 5.

Figure 3:
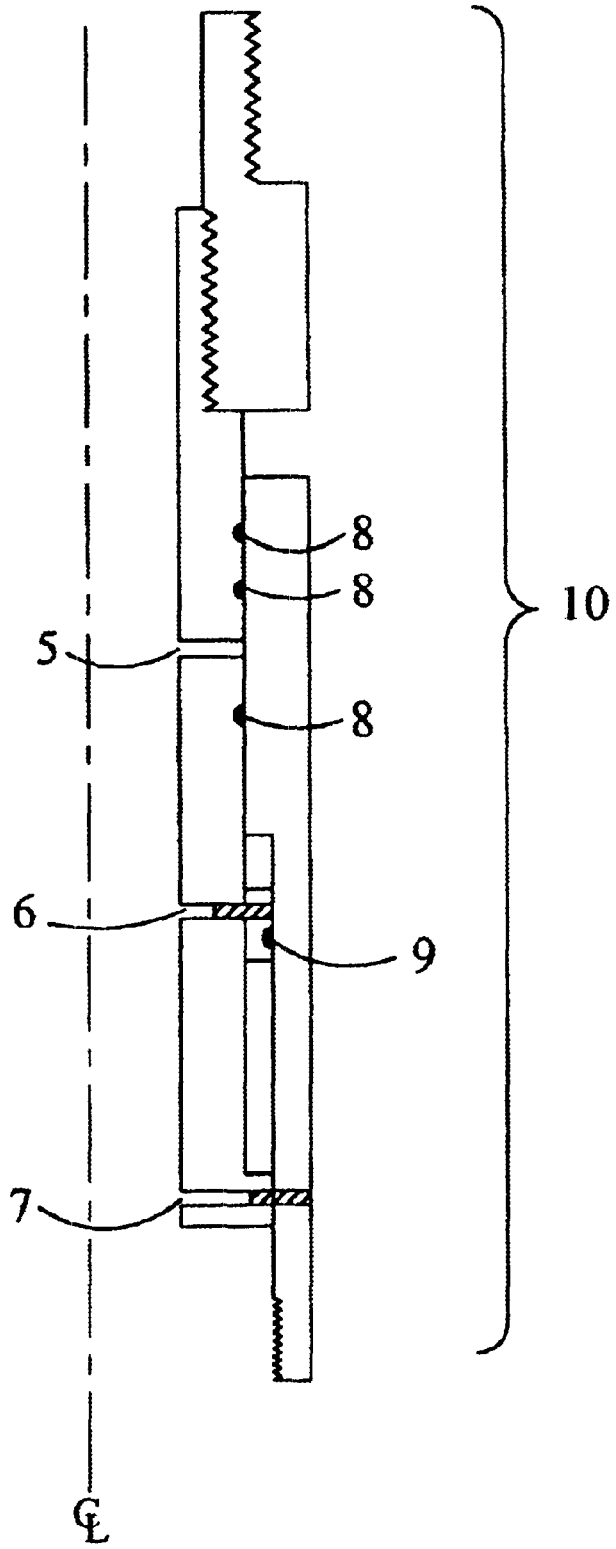
FIG. 3 is a cross-sectional view of the instant device in its "entry" position.
Figure 4:
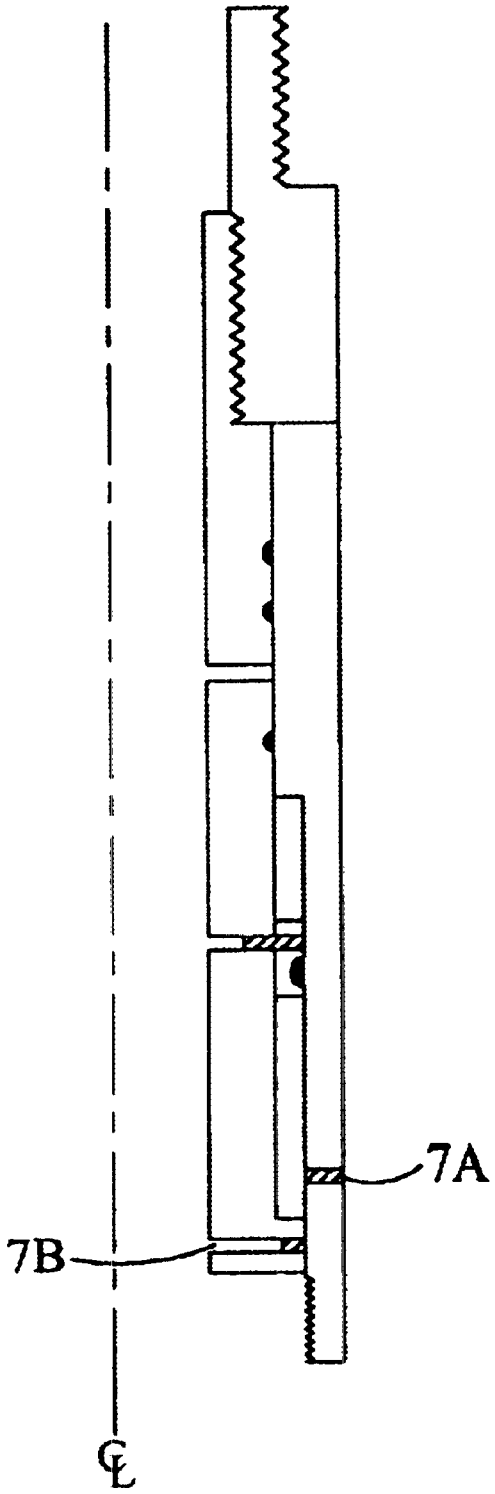
FIG. 4 is a cross-sectional view of the instant device after being taken out of entry or in its "cocked" position.
Figure 5:
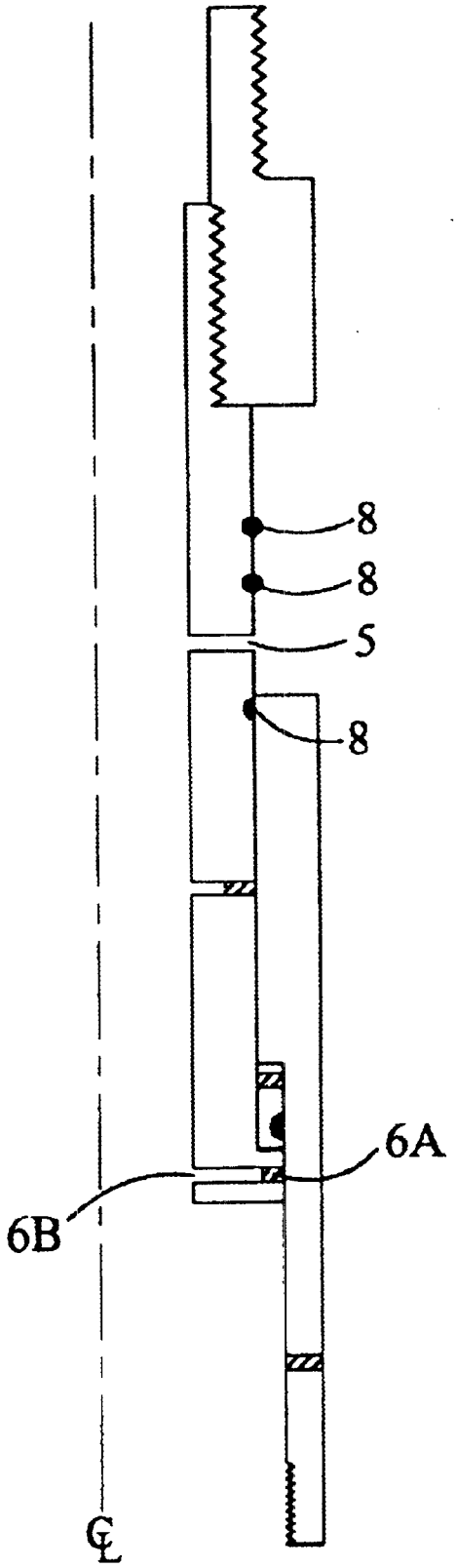
FIG. 5 is a cross-sectional view of the instant device in its "dump" position and ready to come out of the well.

The piston fits (or slides) within a barrel, 1, shown in FIGS. 3–5. Located near the bottom of the barrel is the Barrel Entry Pin aperture, 12, which accepts the Entry Shear Pin(s), 7, (when employed). Located at the bottom of the barrel are threads, 13, which accept a standard valve cage or stinger, 100 (see FIG. 6).

FIG. 3 shows the instant device, 10, in its initial, or safety, assembled position. The device is assembled by placing the safety ring, 4, on the piston, 2, and pinning it in place with the safety shear pin, 6. The safety shear pin passes through the safety ring pin aperture, 41, and the piston safety ring pin aperture, 26. An optional dump ring O-ring, 9, is placed in the optional corresponding groove, 42, on the safety ring. This O-ring is optional and may be left out of the assembly. It is preferred because the O-ring aids in piston assembly and movement of the safety ring within the barrel (stops galling). Further the O-ring may help prevent fluid by-pass if the safety ring shear pin is not tight within the corresponding aperture(s).

The assembly operation is continued by placing O-rings, 8, in the corresponding grooves on the piston and inserting the piston, 2, into the barrel, 1, from the bottom of the barrel. The entry shear pin(s), 7, is (are) then inserted through the barrel entry pin aperture, 12, and into the piston entry pin aperture, 26, located in the piston ring, 21, at the midpoint between the top and the bottom of the ring. The head, 3, is then screwed onto the piston. The resulting "entry" assembly is shown in FIG. 3. Tool grooves are provided on the barrel, the piston and the head so that the threads may be made up to proper torque limits without placing a strain on the shear pins.

The device is installed on a standard downhole reciprocating pump and inserted into the production tubing using standard industry techniques as shown in FIG. 6. In the "entry" position, the O-rings in the upper set of O-ring grooves, 23 and 24, inhibit fluid flow between the inside of the piston and the annulus. FIGS. 3 through 5 show the instant device in its three respective operating positions, entry, cocked closed and dump, as will be explained.

The "entry-position" (as shown in FIG. 3) is not one hundred percent necessary and the step (or position) may be left out; however, practical experience dictates the need for an "entry position." It is known that insertion of a pump into a wellbore is fraught with difficulty—no wellbore is straight! Thus, while inserting the pump into the wellbore it may be necessary to reciprocate and rotate the entire string (pump and rods) when the pump hangs up in the wellbore. The entry position allows for movement of the string without shearing the safety shear pin (as will be explained) which is designed to shear at considerably less force than the entry pin(s). Thus, the force required to shear the entry pin (or pins) is set much higher than the force to shear the safety pin because the hydrostatic head will assist in providing the required shear force. (More than one entry shear pin may be required and the number of pins will be set by the required shear force and is easily determined by one skilled in the art.) The fixed entry position allows the operator to move the pump and device up and down (and rotate) thereby helping the pump enter the wellbore.

To remove the pump from the wellbore, the reciprocating pump sucker rod string or the cable, is lowered further into the wellbore. This operation causes additional weight to be applied to the device, in turn causing the piston to want to move down thereby shearing the entry shear pin(s), 7 (if not already inadvertently sheared). The force applied to the shear pin will equal the hydrostatic head plus the weight of the pump and associated rods. The shear pin(s) is (are) designed to shear at a predetermined pressure OVER the hydrostatic head pressure.

It should be noted that the force required to shear the entry pin(s) is readily supplied by the total weight of the sucker rods 105, pull rod, 104, and pump, 102, in a sucker rod driven pump. This is not the case in a cable driven pump and additional sinker (weight) rods may have to be attached between the pull rod and the cable. Careful choice of the safety shear force and known hydrostatic head may remove the need for additional weight rods in a cable driven pump.

The device is now out of its "entry" position and is ready to operate (see FIG. 4). The rod string or cable is now further withdrawn thereby shearing the safety shear pin, 6, allowing the piston to move to its "dump" position as shown in FIG. 5. The safety ring, 4, sides along the piston and comes to rest against the safety ring, 21, and against the barrel lip, 14; thereby retaining the piston within the barrel. This action exposes the dump port or aperture, 5, that allows fluid in the production tubing to "dump" back into the annulus further washing sand and dumping the hydrostatic head above the pump, 102. The dump port is sized according to hydrostatic head and required dump time. A typical value would be 3/16-inch and a plurality of such apertures may be employed.

The only force that must now be used to remove the pump from within the production tubing is the force required to "pop" the valve cage free of the seating nipple. Thus the device acts to reduce the overall force that must be exerted thereby facilitating ready removal of the pump and reducing the chance that the entire production tubing must be removed.

As explained earlier the instant device may also be employed in tubing pumps. The bottom of the device is attached to the valve cage or stinger and the upper end is attached to the tubing pump standing valve. The standing valve in turn is attached to a retrieving collar (typically shown in FIG. 7) if wire line techniques are to be used. The entire assembly is then dropped down the production tubing and standard operating procedures are then followed. I.e., the well is pressure tested, the tubing pump is run down the tubing and the pump started.

Now allow that the entire tubing must be retrieved. The tubing pump would first be withdrawn. If the entry position shear pins are not employed, then standard wireline fishing techniques are employed and a fish is run down the tubing, which attaches (with luck) to the fishing neck. The line is pulled upwards shearing the safety pin(s) and placing the instant device in the dump position, The entire assembly is then removed from the tubing and the tubing is then retrieved. It should be noted that with a cable pump system, the cable itself will serve as a wireline thereby saving the cost of a wireline service provider.

Alternately, after the pump is withdrawn, standard sucker rods techniques (with or without the entry pins in place) may be used to pull the downhole dump valve to the dump position following the descriptions already given.

Figure 8:
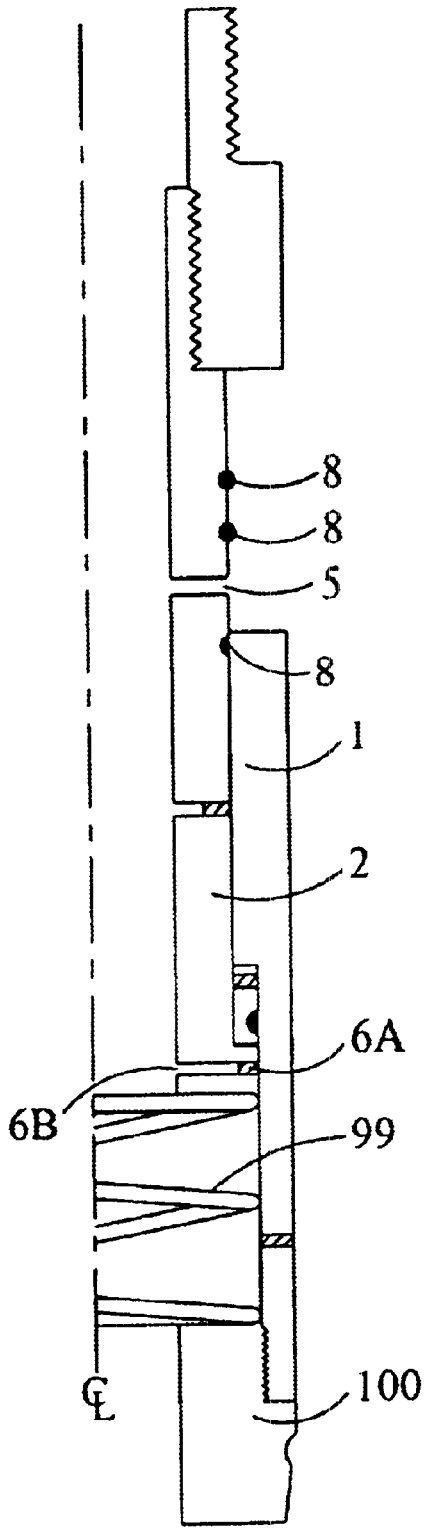
FIG. 8 is a cross-sectional view of the instant device in its "dump" position, showing the spring designed to hold the device in its dump position.

The inventor has an interesting alternate embodiment of the instant device, namely a "one-shot"—dump and forget—device, using a single additional spring, that will be described. When the device is being made up, a suitable spring, 99, is placed at the bottom of the device between the bottom of the piston, 2, and the stinger, 100. (See FIG. 8) The stinger serves to hold the spring in place and loaded against the piston. The entry shear pin(s), if employed and the safety pin serve to keep the dump valve closed. Thus, when the dump valve is pulled to its dump position (by any of the techniques described) the spring will hold the dump valve open once the hydrostatic head dissipates. This embodiment will find great use when wire line techniques are used to open the valve in a tubing pump application.

After the tubing pump is removed and if the tubing is to be retrieved, standard wireline techniques are employed to open the valve via the fishing neck as previously described. However, the entire assembly is not retrieved—just opened and held open until the hydrostatic head dissipates. The wireline is then released and withdrawn. The tubing string may then be pulled with the dump valve spring loaded in the dump position.

There has been described the preferred and best modes for the instant device and methods of use. The choice of metals has not been specified and would be set by standard industry conditions and choices. The size of the dump ports or apertures is typical and a plurality of such apertures may be employed. Standard techniques for sizing shear pins are employed and the entry shear pin may have to be increased to a plurality in order to obtain a desired shear force. For example 0.159-inch one-half hard brass is used for both prototype shear pins. If the entry position is not used, the force to shear safety shear pin may be increased and a plurality of such pins may be required. Such a step is anticipated by this disclosure. Finally, the number of O-rings (and associated grooves) is a matter of choice and may be increased or decreased. Such action is anticipated by this disclosure.

I claim:

1. A method for completely dumping the hydrostatic head in production tubing having a hold-down using a downhole dump valve attached below a pump having associated means for driving the pump for servicing operations comprising:

a) ceasing normal operations;

b) drawing up on the pump drive means thereby raising the pump and opening the dump valve;

c) waiting a predetermined time period to allow the hydrostatic head to dissipate;

d) drawing harder on the pump drive means thereby freeing the pump from the hold-down; and, e) continuing further service operations as needed.

2. A method for completely dumping the hydrostatic head in production tubing having a hold-down using a dump valve in an oil well using a tubing pump for servicing operations comprising:

a) attaching a retrieval tool to a standing valve;

b) attaching the dump valve to the standing valve;

c) attaching a stinger to the dump valve thereby creating a downhole assembly;

d) inserting the assembly in the tubing hold-down;

e) placing the tubing pump in the production tubing;

f) starting normal operations;

g) ceasing normal operations whenever service operations are required;

h) withdrawing the tubing pump;

i) using retrieval techniques to capture the retrieval tool on the downhole assembly;

j) pulling on the retrieval tool thereby opening the dump valve;

k) waiting a predetermined time period to allow the hydrostatic head to dissipate;

l) retrieving the downhole assembly; and m) continuing further service operations as needed.

3. A method for completely dumping the hydrostatic head in production tubing having a hold-down using a dump valve and a hold-open spring in an oil well using a tubing pump for servicing operations wherein fluid may be entrapped in the production tubing comprising:

a) attaching a retrieval tool to a standing valve;

b) attaching the dump valve to the standing valve;

c) inserting the hold-open spring in the dump valve;

d) attaching a stinger to the dump valve thereby creating a downhole assembly;

e) inserting the assembly in the tubing hold-down;

f) starting normal operations;

g) ceasing normal operations whenever service operations are required;

h) withdrawing the tubing pump;

i) using retrieval techniques to capture the retrieval tool on the downhole assembly;

j) pulling on the retrieval tool thereby opening the dump valve;

k) waiting a predetermined time period to allow the hydrostatic head to dissipate;

l) disconnecting from the downhole assembly; and m) continuing further service operations as needed while allowing entrapped fluid to drain through the open dump valve.

* * * * *